US006389649B1

(12) United States Patent
Metzler

(10) Patent No.: US 6,389,649 B1
(45) Date of Patent: May 21, 2002

(54) GARMENT ACCESSORY MOUNTING DEVICE AND METHOD

(76) Inventor: Joyce Metzler, 3750 El Camino Real, #B-3, Atascadero, CA (US) 93422

( * ) Notice: Subject to any disclaimer, the term of this patent is extended or adjusted under 35 U.S.C. 154(b) by 1 days.

(21) Appl. No.: 09/643,220

(22) Filed: Aug. 18, 2000

(51) Int. Cl.[7] ..... A45F 5/08
(52) U.S. Cl. ..... 24/6; 24/710.9
(58) Field of Search ..... 24/6, 5, 12, 357, 24/546, 711, 706.4, 706.3, 707.7, 711.3, 711.2, 710.9; 47/41.01; 132/276

(56) References Cited

U.S. PATENT DOCUMENTS

| | | | | | |
|---|---|---|---|---|---|
| 823,317 | A | * | 6/1906 | Best | 24/710.9 |
| 1,123,352 | A | | 1/1915 | Neiman | |
| 1,554,527 | A | * | 9/1925 | Saalfrank | 24/711 |
| 1,732,213 | A | | 10/1929 | Alland | |
| 1,816,714 | A | | 7/1931 | Adler | |
| 2,047,825 | A | | 7/1936 | Johnson | 24/6 |
| 2,145,531 | A | * | 1/1939 | Shuko | 24/6 |
| 2,361,860 | A | * | 10/1944 | Mason | 24/6 X |
| 2,387,474 | A | | 10/1945 | Spokus | 24/6 |
| 2,549,883 | A | | 4/1951 | Biegajski | 24/103 |
| 2,613,412 | A | * | 10/1952 | Robinson | 24/6 |
| 2,660,771 | A | | 12/1953 | Zarlengo | 24/5 |
| 3,416,195 | A | | 12/1968 | Borthwick | 24/5 |
| 3,735,447 | A | | 5/1973 | Abraham | 24/6 |
| 3,982,303 | A | | 9/1976 | Shulkin | 24/6 |
| 4,229,877 | A | | 10/1980 | Fagan | 29/509 |
| 4,425,679 | A | | 1/1984 | Rizzutto et al. | 24/6 |
| 4,477,946 | A | | 10/1984 | Mafli | 24/5 |
| 4,559,675 | A | | 12/1985 | Devanny | 24/5 |
| 4,773,130 | A | * | 9/1988 | Miller et al. | 24/708.5 |
| 4,852,220 | A | | 8/1989 | Berardi | 24/6 |
| D334,905 | S | | 4/1993 | Riyz | D11/43 |
| 5,836,017 | A | | 11/1998 | Hironaga et al. | 2/69 |

* cited by examiner

*Primary Examiner*—Robert J. Sandy

(57) ABSTRACT

This is a garment accessory-mounting device that provides a safe and easy to use mounting method. Though design variations exist, in the preferred embodiment the device includes a substantially flattened "S" shaped structure. The free ends of the "S", or the two end members, are substantially parallel to one another. A substantially longitudinal base member is positioned between the end members. A pair of joiners connect the base member to each of the end members, one on each end of the base member, thus creating the "S" shape. The distal ends of the end members are end tips that are preferably sharpened to a generally conical shape. This allows the user to spear a flower or other floral arrangement on one of the end members while the other end member is then positioned as a "hook" to easily support the combination on any garment, the weight of the arrangement aiding to hold it in place. A tip cap may be used in some cases to prevent the tip that is on the garment from contacting the user's skin.

30 Claims, 4 Drawing Sheets

GARMENT ACCESSORY MOUNTING DEVICE AND METHOD

BACKGROUND OF THE INVENTION

The invention herein relates to attachment pins and more particularly to pins and other mounting devices that are used to secure flowers or their objects to clothing.

Straight pins are commonly used to secure a boutonniere or corsage to the lapel or collar of the wearer's clothing. Anyone who repeatedly endures the "sticking" process will eventually get stuck. This is true of the wearer and the person placing the flower on the clothing. Straight pins are reasonably functional and inexpensive to manufacture. This accounts for their continued popularity, even though a great deal of art exists each making an attempt to provide a better, and more potentially painless, method.

Previous disclosures have been made, many including large structural elements that are intended to house the base of the flower. These are not only costly to manufacture but bulky, uncomfortable and potentially unflattering to wear. The appearance of the boutonniere or corsage is a fashion accessory. The method of attachment is not. The mounting device should be as small and inconspicuous as possible. Others employ backings or soft or rigid material to support the flowers and still use a form of a straight pin to fasten this to the clothing. To secure the device many include "caps" to enclose the end of the pin. These usually reside on the inside of the clothing and are many times bulky, distorting the shape of the clothing and possibly resting against the skin of the user. With some more fitting garments, over time this could wear against the user's skin and become as uncomfortable as the proverbial pin stick.

Still others use a type of button that is a part of the clothing. This prevents the process of "pinning" someone, in that in most cases a "pin" is not required. If there is a pin, it is likely secured to the button, usually on the exterior of the garment. This reduces the potential for injuring the user, but not the person doing the pinning. The greatest drawback to such a system is that it can only be used with a garment that has this "button" sewn on to it. Formal occasions that desire a floral accessory are as unique as the attire. Modifying a garment to add such a "button" is in many cases not desirable.

SUMMARY OF THE INVENTION

Present Invention:

In one aspect, the invention features a garment accessory mounting device including a substantially longitudinal first end member and a substantially longitudinal second end member. The end members are positioned substantially parallel to one another. The invention also includes a substantially longitudinal base member with a first end and a second end, the base member being disposed between the first end member and the second end member. Finally a first joiner connects the first end member to the first end of the base member and a second joiner connects the second end member to the second end of the base member. The result is a structure that allows an ornamental item, such as a flower or floral arrangement, to be positioned on one end member, the other end member acting as a hook to support the combination on a garment, eliminating the need for traditional straight pins.

The system may also include conical shaped ends on the end tips, on a distal ends of the end members. These conical shapes are sharpened ends, which facilitate the "spearing" of the stem of a flower or other object and for piercing through a garment or other material if necessary. A tip cap can also be used to prevent the sharpened end of the end tip from contacting the wearer's skin.

In another aspect, the invention includes a method of attaching an ornamental item to a garment including the afore noted pin structure while providing a length of floral tape, spearing the ornamental item on an end member of the pin and securing thereto by wrapping the floral tape around a portion of the ornamental item and the end member. The combination of the pin and the ornamental structure is then suitable for hanging on a garment by unused end member of the pin. In the preferred use, the ornamental item is a floral item or group of items.

Definition of Terms:

Unless otherwise defined, all technical and scientific terms used herein have the same intended meaning as would be commonly understood by anyone of ordinary skill in the art to which this invention belongs. To eliminate possible ambiguity, specific terms used herein have been defined, as they would be applied to the present invention.

A "Floral Item" is any flower, plant or combination thereof, living or artificial, which can be used as a fashion accessory.

A "Garment Accessory" is any item that is temporarily secured to a garment for the purpose of aesthetic appearance or identification. A floral item can be a garment accessory.

DETAILED DESCRIPTION OF THE PREFERRED EMBODIMENT

The object of the disclosed invention is to provide an improved device and method of securing and displaying an ornamental object, such as a floral item, on a garment without the use of common straight pins or other more expensive and cumbersome devices.

Figure 1:
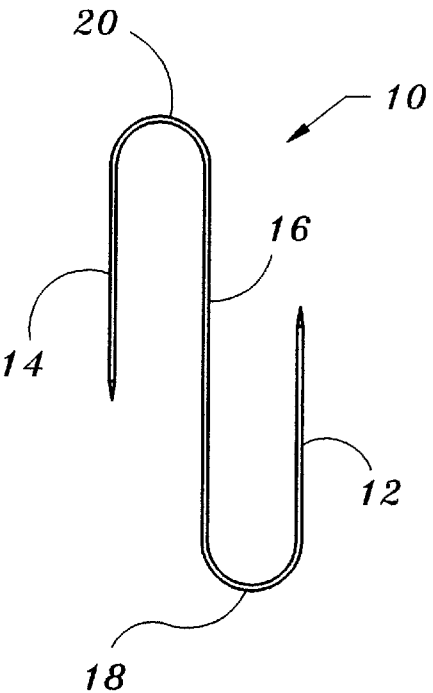
FIG. 1 is a front view of a garment accessory mounting device, the device produced in accordance with a preferred embodiment of the present invention.

What is shown in FIG. 1 is a front view of a garment accessory mounting device 10. The device includes a first end member 12 and a second end member 14, each being substantially longitudinal in shape. The end members are shown here to be positioned parallel or substantially as in this figure. Between the first end member 12 and the second end member 14 is a base member 16. The base member 16 acts as a support to support the end members in their respective positions. In order for this support ability to be realized a connection between the end members and the base member must be maintained. This is done through a pair of joiners. A first joiner 18 connects the first end member 12 to the base member 16 and a second joiner 20 connects the second end member 14 to the base member 16. The resulting combination of structure is a pin that is in the form of an "S". The top and bottom of the "S" being the end members, the base member there between and these member connected by the joiners being the curves in the "S" with the distal ends of the end members positioned in opposite directions to one another.

In this case the first joiner 18 and the second joiner 20 are substantially arcuate in form. This smooth curve is one example and is preferred in that the device is preferably made of a single piece of steel wire preferably between 0.020 and 0.040 inches in diameter. More specifically, the wire is optimally 0.30 inches in diameter and a stainless steel wire to prevent tarnishing in the presence of moisture. Using a forming process to make the device and utilizing this smooth curve places the least amount of stress on the fibers of the material thus increasing the strength and durability of the device.

Figure 2:
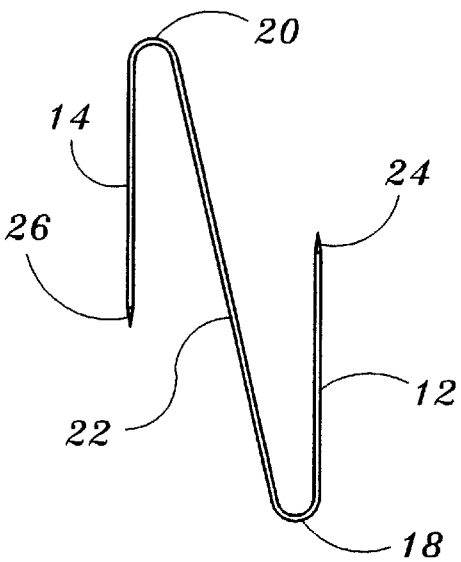
FIG. 2 is a front view of a garment accessory mounting device, the device with an angled base member, the device produced in accordance with an alternative to the preferred embodiment of the present invention.

In the preferred embodiment, as was shown in FIG. 1, the base member 16 is substantially parallel to the first end member 12 and thereby also substantially parallel to the second end member 14. What is shown in FIG. 2 is a version that maintains the substantially parallel nature of the first end member 12 and the second end member 14 with a base member 22 that is positioned there between that are connected by a first joiner 18 and a second joiner 20 respectively. The difference is in the orientation of the base member 22 with respect to the end members (12 & 14). Placement of the base member 22 on an angle can be desirable in that the function of the base member 22 is to support the end members. By placing the base member 22 at an angle between them, the total amount of material is reduced. This not only reduces cost but also increases the structural integrity of the device.

The function of the device is to use the first end member 12 as a tool to impale an ornamental item such as a flower. The second end member 14 has the function of attaching to the garment of an individual. In many cases this will involve piercing through a layer of clothing. In the function of either the end members, a sharpened first end tip 24 or second end tip 26, located on the distal ends of the first end member 12 and the second end member 14 respectively, can be advantageous.

Figure 3:
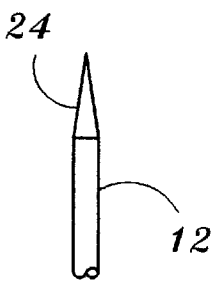
FIG. 3 is the end tip of one of the end members of the device as shown in FIG. 1, the device produced in accordance with a preferred embodiment of the present invention.

What is shown in FIG. 3 is the first end tip 24. The structure of the second end tip 26 is identical to that of the first end tip 24 and therefore will not be discussed apart form this. The tip 24 is comprised of a conical shape and can be made from any number of common manufacturing processes. The exact shape, slope angle and smoothness of finish are not considered relevant to the novelty of the invention, but could effect the function of the device. The tip 24 must be capable of piercing the stem of a flower or a garment of clothing.

Figure 4:
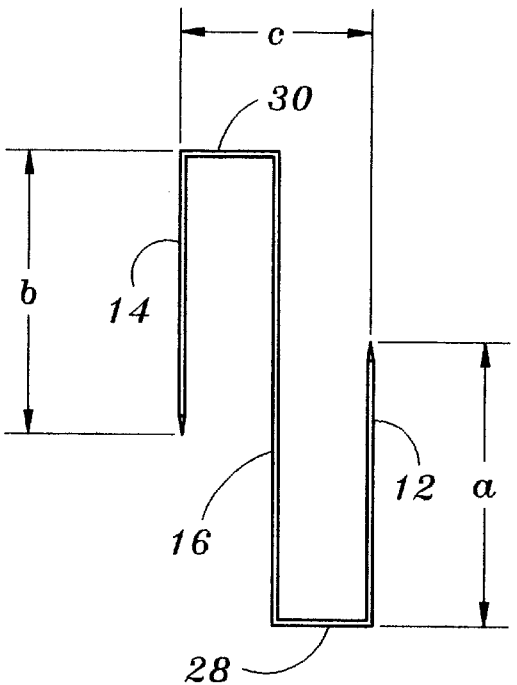
FIG. 4 is a front view of a garment accessory mounting device, the device produced in accordance with an alternative to the preferred embodiment of the present invention.

Another variation of the preferred embodiment is shown in FIG. 4. Here the first end member 12, the second end member 14 and the base member 16 are all identical to that disclosed in FIG. 1. The difference is in the joiners. The first flat joiner 28 again connects the first end member 12 to the base member 16. Instead of a smooth arcuate joiner, as previously disclosed, a flat, or substantially longitudinal shaped joiner is in some cases advantageous. As previously disclosed, the device is preferably made of a single piece of formed wire. The device may also be made from a molded plastic. In such a case the material stresses form forming tight radiuses is not a factor since the part is not formed, but molded. In this case the flat edges of the longitudinal first flat joiner 28 and the second flat joiner 30 may offer greater support for the user's fingers in using the device.

Use of the device has some relevance to its size. The inventor makes no limitation to the size of the device nor to the specific application regarding the type of floral or other item that the user wishes to display. In so far as the preferred embodiment of the invention, some basic dimensions have been found to be most functionally desirable. The inventor offers these as a guideline to support the intended use of the invention and these are not intended to be otherwise limiting. The length of the first end member (a) and the second end member (b) are both preferably between 25 mm and 40 mm in length and optimally each are 32 mm long. The perpendicular distance between the first end member 12 and the second end member 14, as designated by the dimension (c) is between 10 mm and 30 mm and is optimally 20 mm.

Figure 5:
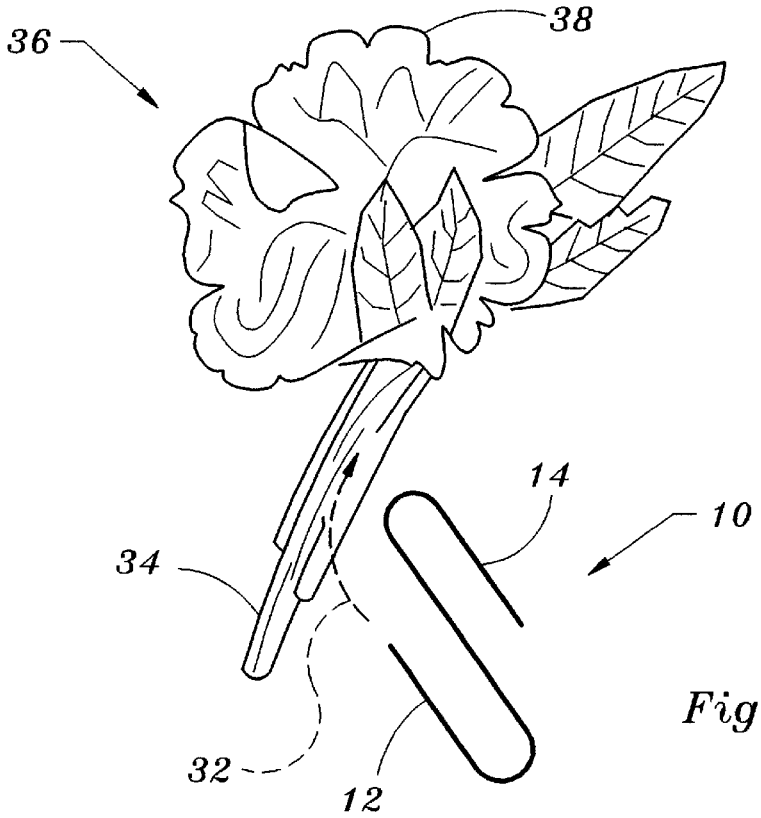
FIG. 5 is a prospective view of a garment accessory mounting device with a floral item (not part of the invention) and the assembly of the device with the floral item as the device would be used in the preferred embodiment.

The use of the device 10 with an article for display is shown in FIG. 5. The arrow 32 shows a preferred method of assembly here. The first end member 12 is inserted in the stem portion 34 of the floral item 36. Since in many cases more than one flower or plant stem is used, the first end member 12 can spear one or more of the stems 34 or just be positioned within the group of stems, or next to any stem. The positioning of the device 10 relative to the flower portion 38 of the arrangement is a personal preference to the user. In most cases the second end member 14 is finally positioned high behind the base of the flower 38. What is shown in the accompanying figures has the second end member 14 lower than might be desired by the average user. This is done for sake of illustration in that the device 10 and its function are better displayed in this manner.

Figure 6:
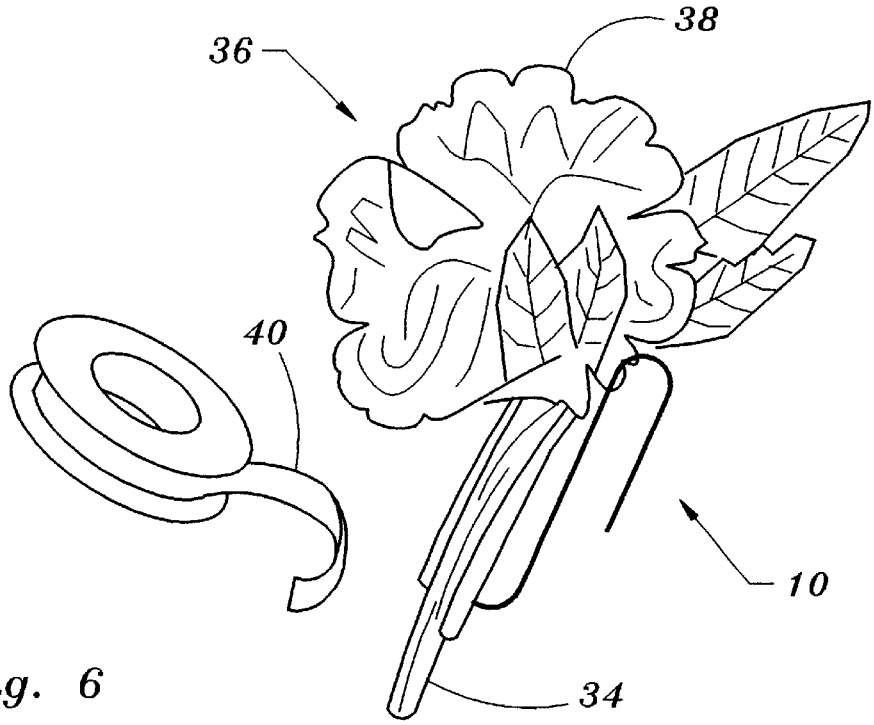
FIG. 6 is a prospective view of a garment accessory-mounting device assembled with a floral item in preparation for being further secured together by floral tape.

Though the use of floral tape 40 to secure the device 10 in place is not always necessary it is desirable. In FIG. 6 the use of floral tape 40 is shown, as it would typically be applied to the assembly. If only one stem 34 exists, it is possible for the device 10 to secure the floral item 36 simply by spearing the stem 34 with the first end member 14 of the device 10. This allows for a simplified, inexpensive and quick attachment means. In many cases more than one flower is used or a single flower is accented with other plants or stems, floral tape 40 is desired to secure the combination together. The tape 40 in this way also helps secure the device 10 to the floral item 36.

The floral tape 40 can be added before spearing the stem with the device 10. Due to the potential for a sharpened end tip, the device can pass through the tape 40 after it is wrapped. This order of assembly allows the user to wrap the stems 34 with the tape 40 without moving about the "obstruction" of the device 10. When the device 10 is positioned higher behind the flower portion 38 of the floral item 36 this potential "obstruction" is virtually eliminated because the device 10 is substantially past the stem 34 portion of the floral item 36 and behind the flower portion 38, which is not wrapped with tape 40.

Figure 7:
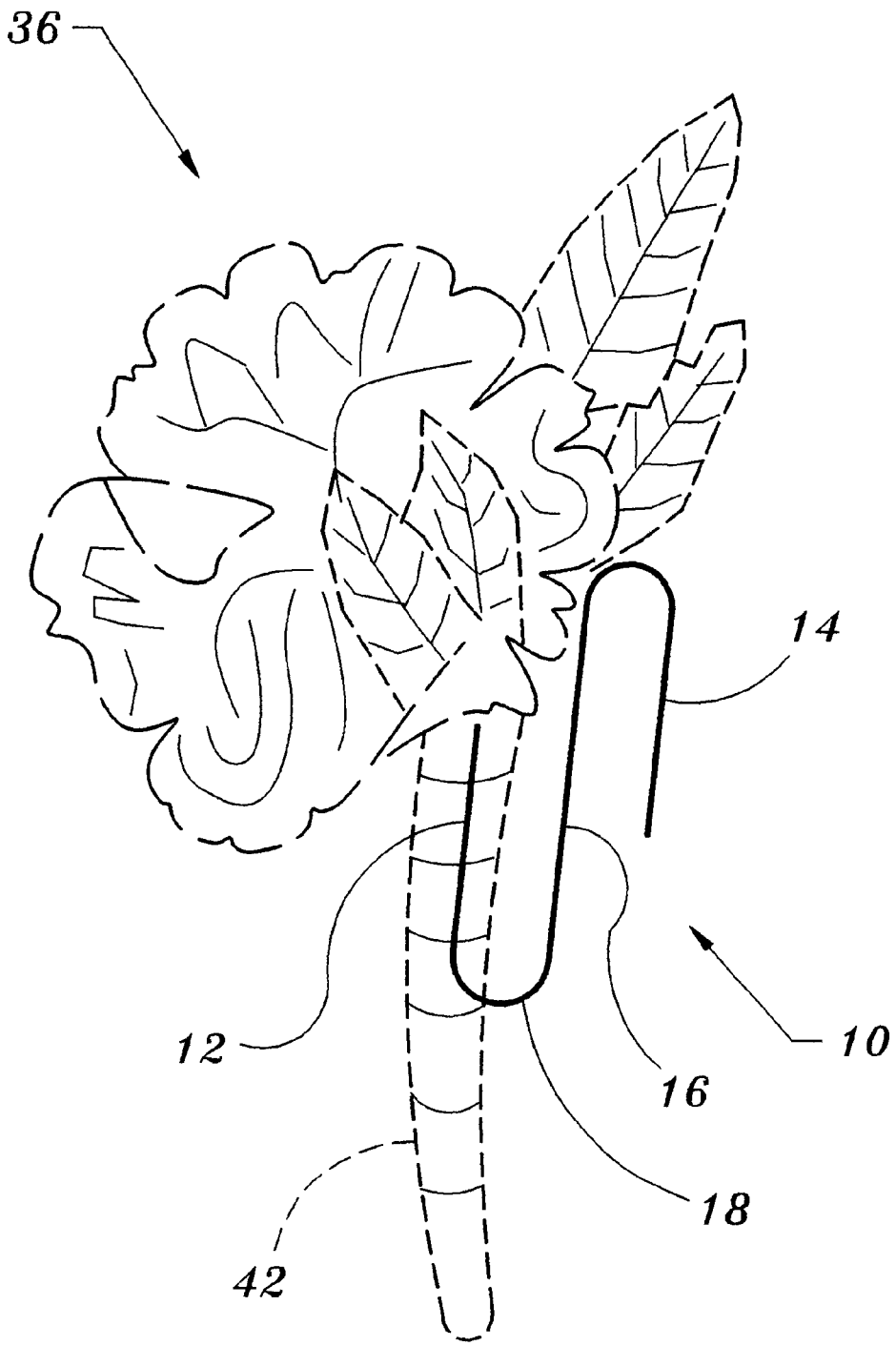
FIG. 7 is a side view of a garment accessory mounting device and a floral item (shown in dashed lines) after being secured together by floral tape.

An example of the finished assembly is shown in FIG. 7. The floral item 36 with a taped stem portion 42 is shown in broken lines, thereby showing the relative position of the device 10. The first end member 12 is within the taped stem portion 42 with the second end member 14 positioned external to the floral item 36. The base member 16 supports the second end member 14, which is also external to the floral item 36. If the floral tape was added after the device 10 was so positioned, it is possible that the base member 16, or the first joiner 18 and a portion of the base member 16 could also be under the floral tape, next to the stems. If the device 10 is desired to the even less conspicuous, this is an option. The preferred embodiment as the intended use is as shown here.

Figure 8:
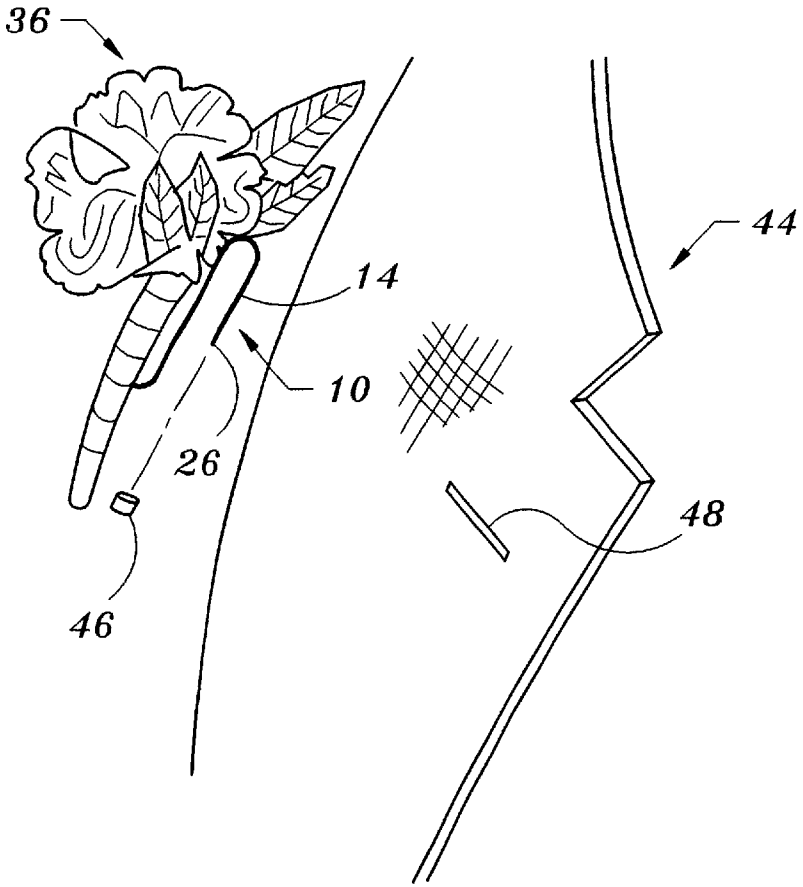
FIG. 8 is a prospective view of a garment accessory mounting device and a floral item assembled together with a tip cap in preparation for placement on the device, the combination shown before display on a garment.

The use as a display item is further illustrated in FIG. 8. The device 10 with the floral item 36 secured thereto is shown near a lapel 44 of a garment, a common method of display. Also shown here is a tip cap 46. This is a device that fits over the second end tip 26 of the second end member 14 of the device 10. The tip cap 46 is likely constructed of a cork or other pliable material that can be received by the end tip 26. The intended purpose of the tip cap 46 is two fold. First, the end tip 26 is likely sharpened to a point to facilitate piercing through material. In some cases this tip 26 could be in contact with the skin of the person wearing the device. It is then desirable to provide an insolative barrier between the tip 26 and the skin. Secondly, the tip cap 46 acts as a fastener to help secure the device 10 and floral item 36 in place. When an orifice, such as a buttonhole 48, is used to place the second end member 14 and hang the combination for display, it is possible that very little friction and primarily gravity is holding the combination on the garment. If the person bends over, the combination could fall. By providing a cap 46 on the end of the second end member 14, the caps offers restriction to becoming dislodged. Though a simple cap is disclosed here, a more complex cap with a positive lock that fits within a grove near the end of the second end member 14 could also be used. These are common with traditional display pins and could also be incorporated here.

Figure 9:
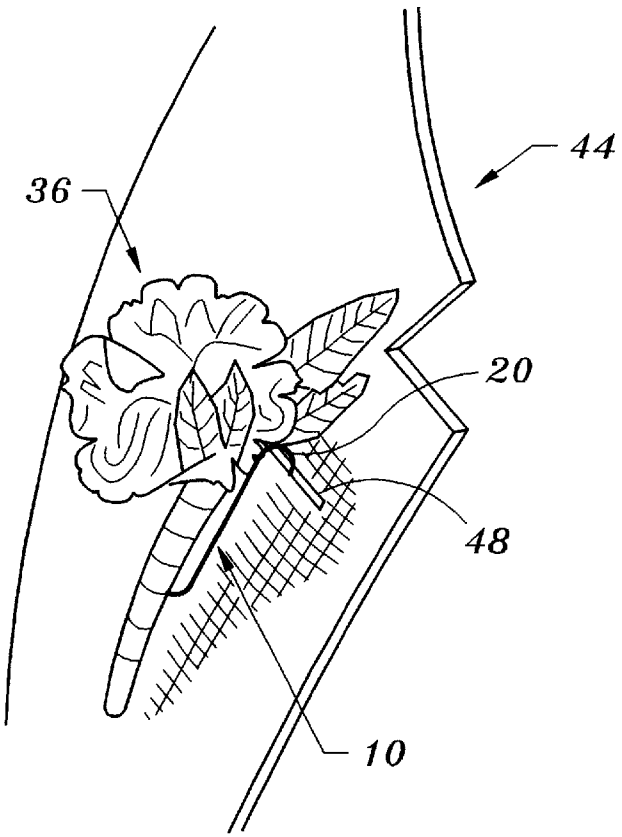
FIG. 9 is a prospective view of a garment accessory mounting device and a floral item assembled together, the combination shown as it would typically be displayed on a garment.

A traditional method of display is shown in FIG. 9. Here the floral item 36 with the device 10 attached thereto is secured to the lapel 44 of a garment. Here the buttonhole 48 in the lapel 44 is used where the second end member 14 is passed through the hole 48 and stops at the second joiner 20. In some cases the user does not want to pierce a hole in what might be an expensive garment. In such a case, this existing hole 48 is desirable. For many, the pin will not cause any damage to the garment and the user will desire to poke the second end member 14 through the garment. This process is more effective in holding the floral item 36 in place.

It is to be understood that all of the enclosed information is presented as the preferred embodiment, or alternatives thereof, as seen by the inventor. An infinite number of variations and modifications can be made including the sizing and positioning of the members of the device.

What is claimed is:

1. A garment accessory mounting device comprising, in combination:

a substantially longitudinal first end member and a substantially longitudinal second end member, said first end member and said second end member positioned substantially parallel to and pointing in substantially opposite directions to one another;

a substantially longitudinal base member with a first end and a second end, the base member being disposed between said first end member and said second end member; and a first joiner connecting said first end member to said first end of said base member and a second joiner connecting said second end member to said second end of said base member, the first end member not in contact with said second joiner and said second end member not in contact with said first joiner, when in a relaxed state.

2. The device as described in claim 1, wherein said first end member includes a first end tip on a distal end thereof that is in a general conical shape and said second end member includes a second end tip on a distal end thereof that is in a general conical shape.

3. The device as described in claim 2, wherein said first end tip and said second end tip are positioned in directions that are opposite to one another.

4. The device as described in claim 2, further comprising a tip cap that is received by said first end tip.

5. The device as described in claim 4, wherein said tip cap is comprised of a cylindrical shaped cork.

6. The device as described in claim 1, wherein said combination is constructed from a single piece of substantially longitudinal material.

7. The device as described in claim 6, wherein said longitudinal material is a steel wire between 0.020 and 0.040 inches in diameter.

8. The device as described in claim 7, wherein said steel wire is stainless steel.

9. The device as described in claim 7, wherein said steel wire is 0.030 inches in diameter.

10. The device as described in claim 1, wherein said first end member and said second end member are each between 25 mm and 40 mm in length.

11. The device as described in claim 10, wherein said first end member and said second end member are each 32 mm in length.

12. The device as described in claim 1, wherein said base member is positioned substantially parallel to said first end member.

13. The device as described in claim 1, wherein a perpendicular distance between said first end member and said second end member is between 10 mm and 30 mm.

14. The device as described in claim 13, wherein said perpendicular distance is 20 mm.

15. The device as described in claim 1, wherein said first joiner and said second joiner are substantially linear in shape.

16. The device as described in claim 1, wherein said first joiner and said second joiner are substantially arcuate in shape.

17. A corsage pin comprising:

a generally "S" shaped structure with two end members being substantially parallel to one another, each end portion including a free end, a substantially longitudinal base member positioned between said end members, and a pair of joiners that connect said base member to each of said end members, the free end of each end portion not in contact with either of said pair of joiners when said pin is in a relaxed state.

18. The device as described in claim 17, wherein each of said free end includes end tips located on a distal end of each end member, the end tips being generally conical in shape.

19. The device as described in claim 18, further comprising a tip cap that is received by at least one end tip.

20. The device as described in claim 19, wherein said tip cap is comprised of a cylindrical shaped cork.

21. The device as described in claim 17, wherein said device is constructed of a material being a steel wire between 0.020 and 0.040 inches in diameter.

22. The device as described in claim 21, wherein said steel wire is stainless steel.

23. The device as described in claim 21, wherein said steel wire is 0.030 inches in diameter.

24. The device as described in claim 17, wherein said first end member and said second end member are each between 25 mm and 40 mm in length.

25. The device as described in claim 17, wherein said first end member and said second end member are each 32 mm in length.

26. The device as described in claim 17, wherein at least a portion of said base member is positioned substantially parallel to said first end member.

27. The device as described in claim 17, wherein a perpendicular distance between said first end member and said second end member is between 10 mm and 30 mm.

28. The device as described in claim 27, wherein a perpendicular distance between said first end member and said second end member is 20 mm.

29. A method of attaching an ornamental item to a garment including the steps of:

providing a pin including:

a substantially longitudinal first end member and a substantially longitudinal second end member, said first end member and said second end member positioned substantially parallel to and pointing in substantially opposite directions to one another;

a substantially longitudinal base member with a first end and a second end, the base member being disposed between said first end member and said second end member; and a first joiner connecting said first end member to said first end of said base member and a second joiner connecting said second end member to said second end of said base member, the first end member not in contact with said second joiner and said second end member not in contact with said first joiner when in a relaxed state;

providing an ornamental item to be attached to a garment;

providing a length of floral tape;

spearing said ornamental item on said second end member of said pin and securing thereto by wrapping said floral tape around a portion of said ornamental item and said second end member; and hanging said pin and attached ornamental item on a garment by said first end member of said pin.

30. The method as described in claim 29, wherein said ornamental item is comprised of a floral item.

* * * * *